US005133397A

United States Patent [19]

Lohausen

[11] Patent Number: 5,133,397

[45] Date of Patent: Jul. 28, 1992

[54] AWNING WITH CENTRAL FIXING SECTION

[76] Inventor: Viktor Lohausen, Am Lerchenberg 28, D7101 Oberheinriet Bundesrepublik Deutschland, Fed. Rep. of Germany

[21] Appl. No.: 392,624

[22] PCT Filed: Mar. 4, 1988

[86] PCT No.: PCT/DE88/00118

§ 371 Date: Jul. 17, 1989

§ 102(e) Date: Jul. 17, 1989

[87] PCT Pub. No.: WO88/07115

PCT Pub. Date: Sep. 22, 1988

[30] Foreign Application Priority Data

Mar. 13, 1987 [DE] Fed. Rep. of Germany ..... 3708155

[51] Int. Cl.[5] ..... E04F 10/00

[52] U.S. Cl. ..... 160/22; 135/89

[58] Field of Search ..... 160/22, 66, 67, 68; 135/89

[56] References Cited

U.S. PATENT DOCUMENTS 4,469,159 9/1984 Lohausen ..... 160/22

FOREIGN PATENT DOCUMENTS 2125291 9/1972 France .
2306314 10/1976 France .
2311170 12/1976 France .

*Primary Examiner*—Blair M. Johnson
*Attorney, Agent, or Firm*—Sughrue, Mion, Zinn, Macpeak & Seas

[57] ABSTRACT

A stationary roll type awning has a central fixing section including a housing. An inner space of approximately circular cross-section within the housing accommodates a cloth shaft. A central supporting element forms at least one part of the housing. At least one continuous open chamber is formed within the central supporting element and guide strips are provided on the outer side of the central supporting element. Reinforcement sections are inserted into the open chamber. A plurality of bearing pedestals are secured to the central supporting element and support swivel shafts and tilt limiters, thereby reinforcing the housing. In securing the bearing pedestals 11 to the central supporting element, the reinforcement profiles are firmly pressed onto the guide strips of the open chamber via the bearing pedestals.

15 Claims, 2 Drawing Sheets

AWNING WITH CENTRAL FIXING SECTION

Figure 1:
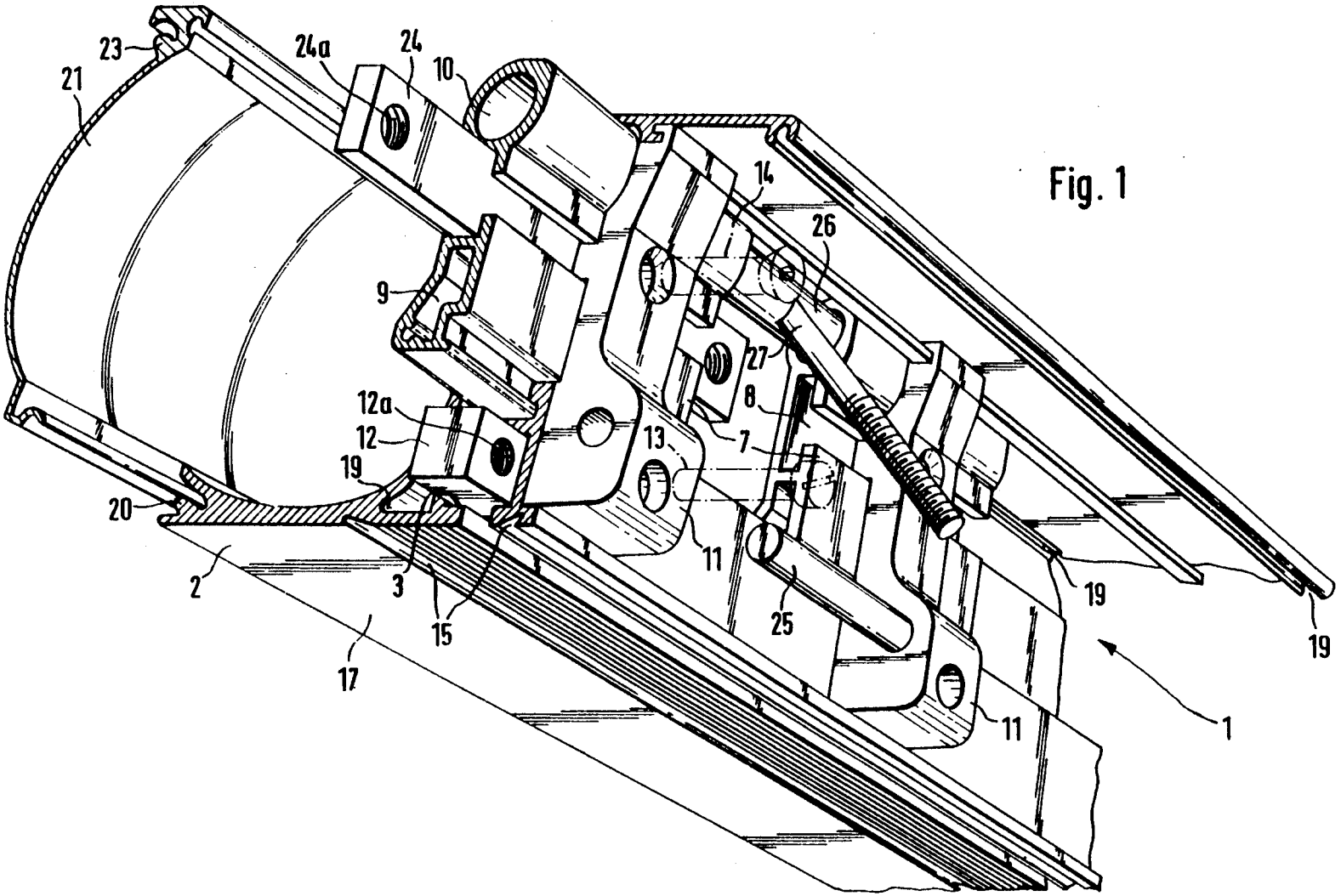

The invention relates to a stationary roll type awning such as that of applicant's U.S. Pat. No. 4,469,159, with central fixing section with a housing with an inner space with an approximately circular cross-section to accommodate a cloth shaft and with a central supporting element which forms at least one part of the housing. Such an awning is known from DE-A-21 07 477, for example. This awning possesses a sturdy box which accommodates the cloth roll and on which a U-shaped rail is mounted containing the swivel arms and which can be swiveled forward by 90°.

An awning with a central web as a central supporting element is known from U.S. Pat. No. 4,469,159 of the applicant, whereby the housing accommodating the cloth roll with cloth shaft possesses a square cross-section. This narrow central web supports one bearing pedestal in each case at its top and bottom ends to accommodate one horizontal articulated shaft in each case for mobile fixing of individual parts. Furthermore, an awning with a tubular housing with an inner space with approximately circular cross-section to accommodate a cloth shaft is known from DE-A-26 20 112, whereby the housing is held by two brackets. In addition, an awning with a housing for the cloth roll with circular cross-section is known from DE-OS 25 14 941. However, a continuous supporting element, supporting tube or supporting rail serving the purpose of reliable and movable fixing of the brackets and arm fixing elements is missing. The housing itself is not suitable to absorb any forces.

In all previously known designs, the dimensions transverse to the longitudinal direction were always too large, in spite of all design efforts. It cannot be overlooked, however, that the whole swivel mechanism must be particulary sturdy and above all torsionally rigid for the forces required to extend and retract the awning, particularly with the weight of the awning material, the articulated and swivel arms and, specially for safety reasons, owing to the strength with respect to wind load required by authorities as well as owing to resistance to wear. This alone places certain limits on reduction of the dimensions.

On the other hand, however, the design must be such that it can be realized for the widest possible variety of length dimensions without changes to the design principle.

In particular, one must demand that the awning be able to be adapted to the widest possible range of distances between fixing points without extensive and difficult reworking on-site. Admittedly, these are demands which initially appeared completely opposed to a light-weight design.

However, the invention has set itself the task of creating an awning of the type mentioned above with which these inherently contradictory demands can be satisfied in an astonishingly simple manner. This is achieved in the invention by the fact that at least one continuous open chamber with guide strips or stop strips is provided on the outer side of the central supporting element and that reinforcement sections which can be slid into this chamber are provided which are used at the same time indirectly or directly to secure the bearing pedestals for the swivel arms, tilt limiters, gear parts or as a coupling, thus reinforcing the whole construction, whereby these reinforcement sections possess one or more closed and/or open chambers. The arrangement should preferably be such that the reinforcement sections possess an open chamber to accommodate fixing means and at least one further closed chamber in a center section.

It is particularly advantageous that the bearing pedestals for the swivel arms are secured on the one hand by means of bolts and nuts in a continuous groove on the bottom end of the central supporting element and, on the other, by means of fixing means at the reinforcement sections.

Tilt limiters or a drive for awning adjustment can also be secured in the same way.

Refer to the other individual claims for further embodiments of the invention.

The invention will now be described in more detail in conjunction with the enclosed drawings on the basis of an example embodiment.

Figure 2:
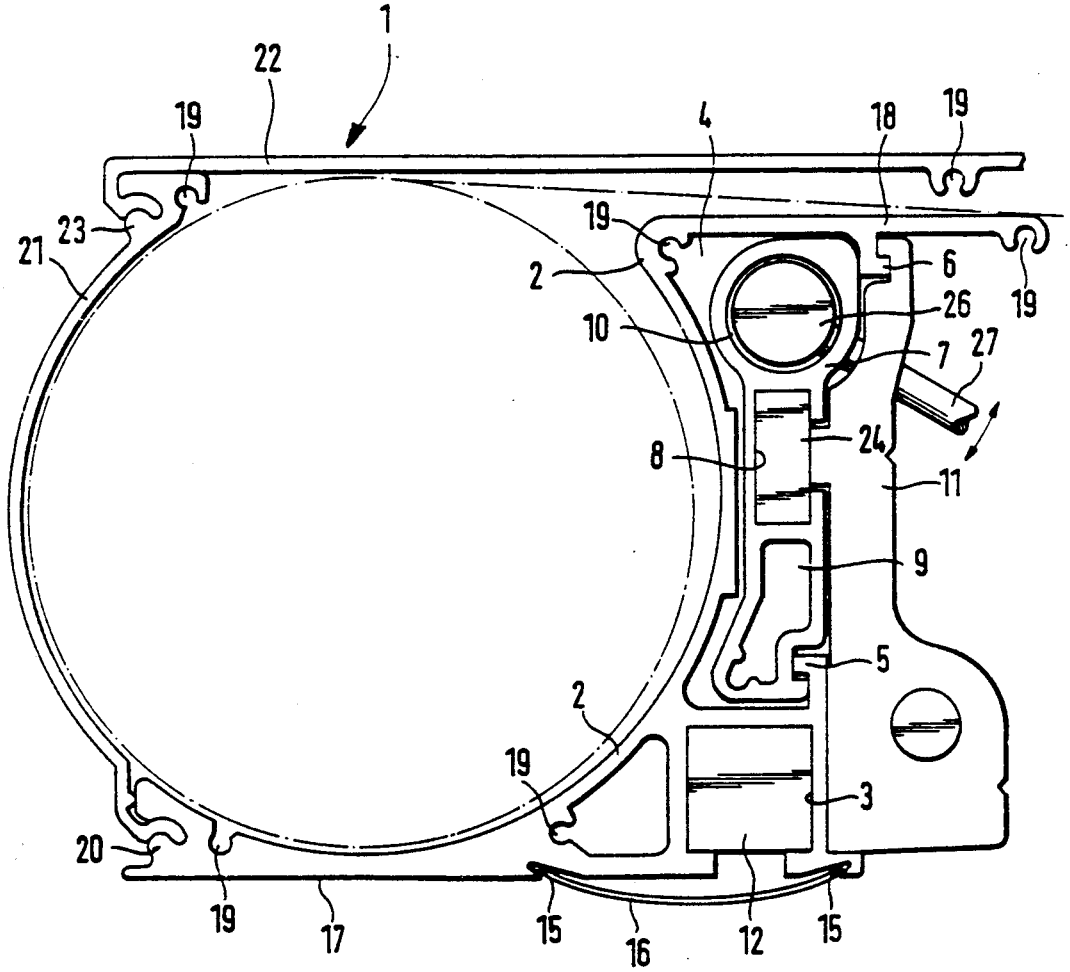

In the drawings,

FIGS. 1 and 2 show a perspective side view and a cross-sectional view of an embodiment of the invention.

In both figures, it is possible to first see generally a housing 1 containing a central supporting element 2. This supporting element possesses a continuous chamber 3 at its bottom end which serves to accommodate fixing means, as will be described in detail later on. In addition, the central supporting element possesses an open chamber 4 which is limited at its top and bottom ends by a guide strip 5 or a guide or stop strip 6 in each case.

Reinforcement sections 7 are placed in this chamber. These reinforcement profiles can clearly be seen both in the sectional view of FIG. 2 and in FIG. 1. The length of these reinforcement sections is in effect arbitrary and will be selected in accordance with the respective requirements. The same also applies to the wall thickness.

As can be seen in FIG. 2, these reinforcement sections 7 possess an open chamber 8 in a center section which, however, possesses two guide strips at its top and bottom ends. In addition, a closed chamber 9 containing reinforcement beads is provided in the reinforcement sections at the bottom end, thus increasing the rigidity of this section. Furthermore, the reinforcement sections possess a guide strip on this side which ensures reliable guidance of the reinforcement sections at the guide strip 5 in the supporting element.

A further chamber 10 is provided at the top end of these reinforcement sections. This is shown here as completely closed, although a gap opening would also be permissible. The closed chamber 10 also produces extremely high rigidity.

The swivel arms are secured by bearing pedestals 11, which are bulged at the bottom ends and possess a bore in longitudinal direction which accommodates the swivel shaft. These bearing pedestals are secured on the one hand at nuts 12, which can be inserted in the chamber 3, by means of bolts 13 which penetrate the side wall of chamber 3. Such a nut 12 can be seen clearly in both figures. The length of these nuts is also basically arbitrary, but will always be adapted to the requirements.

The bolts 13 for securing the bearing pedestals 11 on the central supporting element 2 are hinted at in FIG. 1. The bearing pedestals are then also secured by the bolts 14, which are also hinted at in FIG. 1. This will be dealt with in more detail later.

Continuous grooves 15 are provided on the underside of the supporting element 2, which should preferably run inward at an angle as shown. A screen 16 can be snapped into these grooves (FIG. 2). Since the screen can consist of several parts, the parts can also be inserted overlapping.

The central supporting element 2 possesses a horizontal section pointing backwards and with a flat end surface 17 at its bottom end. In addition, the central supporting element 2 possesses a flat guide element 18 pointing forward for the awning cloth at its upper end. Mounting channels 19 are provided on all side surfaces of the central supporting element 2 which accommodate fixing means, for example bolts for the side parts (not shown).

At the rear end of the central supporting element, there is a continuous groove 20 in which the shell 21 forming part of the housing can be inserted. On the other hand, the central supporting element 2 and shell 21 could also consist of one piece.

A roof 22, which closes off the housing 1 to the top, is inserted in a similar continuous groove 23 in the shell 21. The shell 21 and the roof 22 also possess mounting channels 19 for accommodation of the fixing means for the side parts. The whole construction is thus held together stably when the side parts are secured.

Nuts 24 which can be inserted in the open chamber 8 of the reinforcement sections 7 are used for additionally fixing the bearing pedestals 11. Such a nut 24 possesses, for example, several threaded bores 24*a*. Fixing is then such that a bolt 14 is inserted through a bore through bearing pedestal 11 and screwed into nut 24. When these bolts are tightened firmly, the nut is tightened against the guide strip of chamber 8, thus already producing extremely high rigidity.

Normally, the place at which the bearing pedestals are to be installed is not known in advance. However, this is not related to difficulties, because it is possible at any time to drill through the side wall of chamber 3 through the bores of the bearing pedestals in order to screw the fixing bolts into already existing threaded bores 12 A in nut 12 at this position. It is also conceivable that a threaded bore be produced in nut 12 through the bore in the bearing pedestal and through the bore in the side wall of chamber 3.

Chamber 10 serves the purpose of fixing gear parts for the shaft of an adjusting screw. This chamber may be both continuous or realized only as a bore in which a shaft can then be inserted. As is shown in FIG. 1, for example, a continuous bore is provided at the bottom in both bearing pedestals 11 into which a tilting shaft 25 can be inserted, for example. In the same way, a shaft 26 for the adjusting screw 27, which acts as an adjusting screw for the tilt angle, is inserted in chamber 10, which can also be realized as a non-continuous bore. It is then possible to secure a tilt limiter, for example, on the tilting shaft 25.

It is clearly evident that the whole construction of the central supporting element is provided with the required rigidity by the reinforcement sections 7 which can be inserted in chamber 4. This is achieved above all by the fact that, when securing the bearing pedestals, the bolts inserted in nuts 12 and 24 press the bearing pedestals 11 firmly against the side wall of the chamber on the one hand and, on the other, press the reinforcement sections 7 firmly onto the guide strip 6, onto which the bearing pedestals are also hooked by means of a continuous strip.

A construction which might appear to be not very stable at first glance is rendered exceptionally stable in this way and is thus in a position to fully absorb all loads.

In particular, the new construction has achieved a considerable reduction in the cross-sectional dimensions of the overall construction without impairment of the required strength and rigidity. The extensive use of extruded sections results in a not inconsiderable simplification, improvement in stability and above all in reduction in cost.

Finally, it must be mentioned that these reinforcement sections can also be used to couple several central supporting elements with each other. This is also achieved using bearing pedestals, for example, which are then used only as fixing elements for the connection between the supporting elements and the reinforcement sections.

We claim:

1. In a stationary roll type awning comprising: a central fixing section including a housing (1) having an inner space of approximately circular cross-section to accommodate a cloth shaft, a central supporting element (2) forming at least one part of said housing, the improvement comprising: at least one continuous open chamber (4), guide strips (5, 6) provided on an outer side of a central supporting element (2), reinforcement sections (7) inserted into said open chamber (4), and means for securing bearing pedestals (11) supporting at least one swivel shaft to said central supporting element (2) to reinforce the housing, and means for pressing reinforcement sections (7) firmly onto said guide strips (5, 6) of the open chamber (4) by said bearing pedestal securing means.

2. Awning in accordance with claim 1, wherein the reinforcement sections possess at least one further chamber (8, 9, 10).

3. Awning in accordance with claim 1, wherein the reinforcement sections include an open chamber (8) accommodating fixing means and at least one other, closed chamber (9, 10) in a center section thereof.

4. Awning in accordance with claim 1, wherein the reinforcement sections are solid sections and are provided with bores accommodating fixing means.

5. Awning in accordance with claim 1, wherein the reinforcement sections possess a bore (10) accommodating said swivel shafts in a top section thereof.

6. Awning in accordance with claim 1, wherein the outer side of the central supporting element (2) is curved convexly approximately in an arch shape and the reinforcement sections match the contour of the central supporting element.

7. Awning in accordance with claim 5, wherein the bearing pedestals (11) carrying the swivel shafts are secured by bolts and nuts (12) in a continuous groove at a bottom end of the central supporting element (2) and by fixing means at the reinforcement sections.

8. Awning in accordance with claim 1, wherein a gear acting as a drive for awning adjustment is secured on the central supporting element by a reinforcement section.

9. Awning in accordance with claim 1, wherein two continuous grooves (15) are provided on the bottom side of the supporting element and a snap-in cover screen (16) has opposite edges snapped into respective grooves.

10. Awning in accordance with claim 1, wherein the central supporting element possesses a horizontal end surface (17) at a bottom end thereof, and the supporting element has a projecting flat guide element (18) at a front upper end thereof and means (19) are provided on an outer edge of the supporting element for detachable accommodation of a side bearing.

11. Awning in accordance with claim 1, wherein the housing (1) is unitary with the central supporting element (2).

12. Awning in accordance with claim 1, wherein the housing (1) consists of the central supporting element (2) and a shell (21) secured to said central supporting element.

13. Awning in accordance with claim 1, wherein the reinforcement sections (7) couple multiple awnings.

14. In a stationary roll type awning comprising: a central fixing section including a housing (1) having an inner space of approximately circular cross-section to accommodate a cloth shaft, a central supporting element (2) forming at least one part of said housing, the improvement comprising: at least one continuous open chamber (4), guide strips (5, 6) provided on an outer side of a central supporting element (2), reinforcement sections (7) inserted into said open chamber (4), and means for securing bearing pedestals (11) supporting at least one tilt limiter to said central supporting element (2) to reinforce the housing, and means for pressing reinforcement sections (7) firmly onto said guide strips (5, 6) of the open chamber (4) by said bearing pedestal securing means.

15. Awning in accordance with claim 14, wherein said at least one tilt limiter is placed in the central supporting element secured by the reinforcement sections.

* * * * *